US007541902B2

(12) United States Patent
Domejean et al.

(10) Patent No.: US 7,541,902 B2
(45) Date of Patent: Jun. 2, 2009

(54) ARC CHUTE AND CIRCUIT BREAKER EQUIPPED WITH ONE SUCH ARC CHUTE

(75) Inventors: Eric Domejean, Voreppe (FR); Thierry Bec-Lucat, Crolles (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 12/081,561

(22) Filed: Apr. 17, 2008

(65) Prior Publication Data

US 2008/0290068 A1 Nov. 27, 2008

(30) Foreign Application Priority Data

May 22, 2007 (FR) ..... 07 03632

(51) Int. Cl.
*H01H 9/30* (2006.01)

(52) U.S. Cl. ..... 335/201; 218/23; 218/26

(58) Field of Classification Search ..... 335/201; 218/22–28

See application file for complete search history.

(56) References Cited

FOREIGN PATENT DOCUMENTS

| | | |
|---|---|---|
| DE | 33 11 052 | 9/1984 |
| DE | 20 2005 007878 | 9/2006 |
| EP | 0 473 013 | 3/1992 |
| EP | 1 693 869 | 8/2006 |
| FR | 2 622 736 | 5/1989 |

*Primary Examiner*—Ramon M Barrera
(74) *Attorney, Agent, or Firm*—Steptoe & Johnson LLP

(57) ABSTRACT

An arc chute comprising an arc extinguishing chamber formed by a stack of deionizing plates and an arc formation chamber bounded by a first and second flange, said arc chute being equipped with permanent magnets arranged behind at least the first flange, in which the arc formation chamber comprises:

an enhanced induction section where the arc is propelled towards the arc extinguishing chamber by a first part of the permanent magnets, and a diverting section where the arc is diverted towards the first flange by a second part of the permanent magnets, the magnetic field in the longitudinal mid-plane generated by the second part being substantially weaker than that generated by the first part.

A circuit breaker comprising separable contacts and the previously described arc chute.

11 Claims, 2 Drawing Sheets

ARC CHUTE AND CIRCUIT BREAKER EQUIPPED WITH ONE SUCH ARC CHUTE

BACKGROUND OF THE INVENTION

The invention relates to the field of switchgear devices in particular enabling direct currents to be broken, in particular low-intensity currents, i.e. comprised between 0.5 and 150 Amperes.

The invention relates to an arc chute for a circuit breaker comprising an arc extinguishing chamber formed by a stack of deionizing plates and an arc formation chamber bounded by a first and second flange, said arc chute being equipped with permanent magnets arranged behind at least the first flange.

The invention also relates to a circuit breaker comprising separable contacts and an arc chute to extinguish an electric arc formed when opening of said contacts takes place.

STATE OF THE ART

The arc formation chamber of an arc chute generally extends between a contact zone and the arc extinguishing chamber. In the contact zone, formation of the arc is initiated by separation of said contacts. More often than not, one contact is movable and the other is stationary. This contact zone generally comprises means for picking up the arc, more often than not electrodes or arcing horns, contributing to the arc leaving the contacts and being removed to the arc extinguishing chamber. The arc generally moves in a space bounded by two flanges, made from electrically insulating material, between the contact zone up to the deionizing plates of the arc extinguishing chamber.

When breaking generated by a variable or direct current of high intensity, i.e. more than about 150 Amperes, takes place, the electromagnetic force induced by the current flow in one of the conductors connected to the contacts is generally sufficient to propel the arc and remove it rapidly to the deionizing plates of the arc extinguishing chamber.

However, when breaking generated by a direct current of low intensity takes place, this electromagnetic force may not be sufficient to propel the arc sufficiently and remove it to the deionizing plates.

French Patent application FR2622736 describes a circuit breaker equipped with an arc chute comprising a permanent magnet arranged between one of the flanges of the arc formation chamber and the adjacent wall of the circuit breaker case. This permanent magnet enables the electric arc formed by breaking of a direct current of low intensity to be propelled.

One drawback of such an arc chute is that the magnetic field of the permanent magnet is sometimes insufficient to efficiently propel and remove the electric arc to the arc extinguishing chamber. Moreover, the magnetic field generated by the permanent magnet may tend to attract the arc to the flange adjacent to this magnet and prevent progression thereof and evacuation thereof to the arc extinguishing chamber.

SUMMARY OF THE INVENTION

The object of the invention is to remedy the shortcomings of arc chutes of the prior art by proposing an arc chute for a circuit breaker comprising an arc extinguishing chamber formed by a stack of deionizing plates and an arc formation chamber bounded by a first and second flange situated substantially at equal distance from a longitudinal mid-plane, said arc chute being equipped with permanent magnets at least partly arranged behind the first flange, the arc formation chamber comprising a first enhanced induction section and a diverting section between said enhanced induction section and the arc extinguishing chamber.

In the arc chute according to the invention, the enhanced induction section comprises a first part of the permanent magnets generating a magnetic field in the longitudinal mid-plane of said section enabling the electric arc to be propelled, said first part of the permanent magnets comprising two magnetized fractions arranged behind each of the flanges, the diverting section comprising a second part of the permanent magnets generating a substantially weaker magnetic field in the longitudinal mid-plane of said section than that generated by the first part of the permanent magnets and enabling the electric arc to be diverted with respect to the longitudinal mid-plane.

The first and second flange are preferably situated substantially at equal distance from the longitudinal mid-plane. Advantageously, the two magnetized fractions of the first part of the permanent magnets generate magnetic fields having substantially equal intensities. Advantageously, the two magnetized fractions of the first part of the permanent magnets are arranged symmetrically with respect to the longitudinal mid-plane of the arc formation chamber.

According to one embodiment, at least one fraction of the second part of the permanent magnets is arranged behind the first flange so that the magnetic field generated by said fraction is greater than that generated by the remaining fraction of the second part of the permanent magnets. Preferably, the whole of the second part of the permanent magnets is arranged behind the first flange.

Preferably, the deionizing plates comprise a leading edge equipped with a central recess and with at least one lateral part oriented towards the diverting section, the electric arc being directed in the diverting section towards said lateral part. Advantageously, the distance between the second part of the permanent magnets and the lateral part of the leading edge of the deionizing plates is smaller than 1 millimeter.

According to one embodiment, the first flange is made of ceramic material. Preferably, the second flange is made of gas-generating organic material.

The invention also relates to a circuit breaker comprising separable contacts and an arc chute to extinguish an electric arc formed when opening of said contacts takes place, the arc chute being as described previously.

BRIEF DESCRIPTION OF THE DRAWINGS

Other advantages and features will become more clearly apparent from the following description of particular embodiments of the invention, given as non-restrictive examples only, and represented in the accompanying figures.

DETAILED DESCRIPTION OF AN EMBODIMENT

Figure 1:
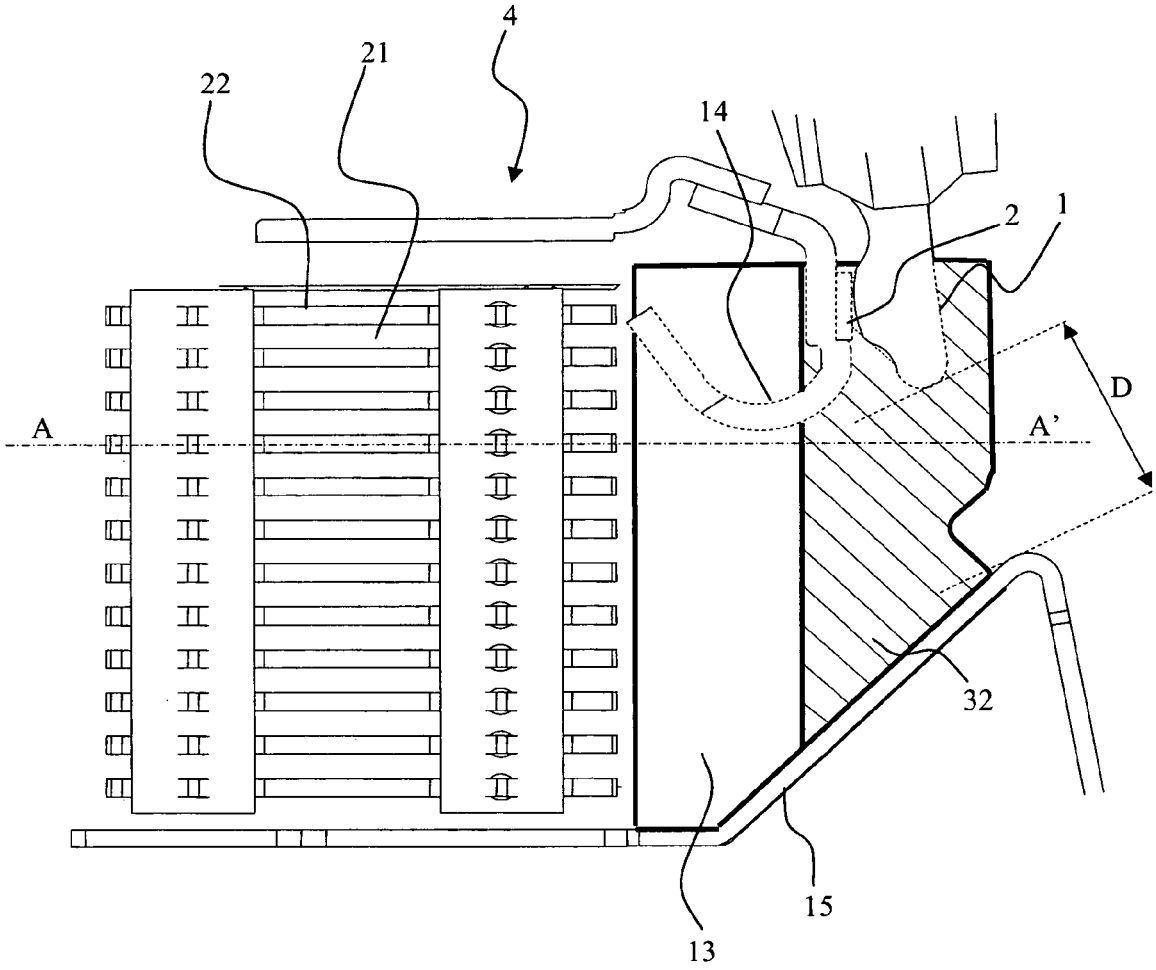
FIG. 1 represents a partial view of a circuit breaker pole-unit presenting an arc chute according to the invention.
Figure 2:
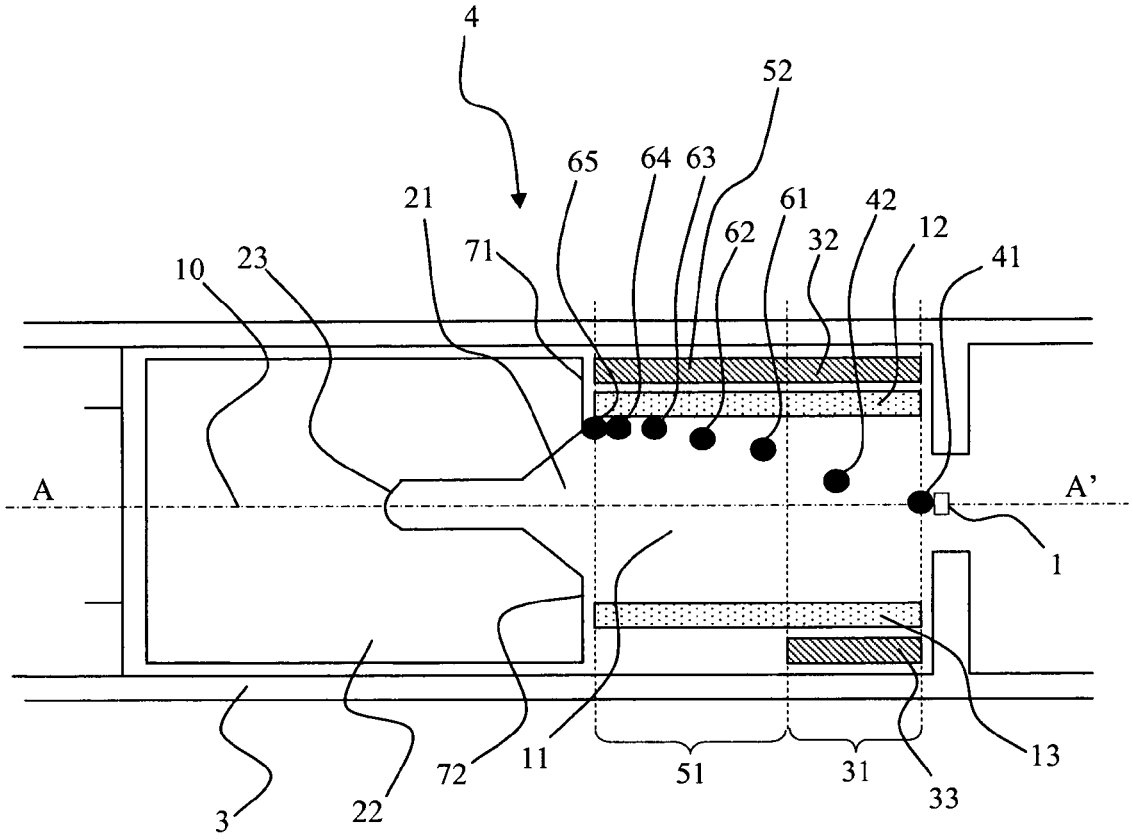
FIG. 2 represents a partial view of the circuit breaker pole-unit of FIG. 1 in cross-section along a longitudinal axis A-A' in the longitudinal mid-plane.

As represented in FIGS. 1 and 2, the circuit breaker pole-unit comprises a movable contact mobile 1 and a stationary contact 2, each of these contacts being connected by means of a conductor to a connection terminal of the circuit breaker. Opening of the movable contact can be commanded by an operating mechanism by means of a handle or by tripping means which are not represented. These tripping means can comprise an electromagnetic trip unit and a thermal trip unit able to bring about automatic opening of movable contact 1, in the event of an overload or short-circuit occurring.

The circuit breaker elements, such as the separable contacts, operating mechanism and trip means, are generally housed in a moulded case 3 made of insulating material. As represented in FIG. 2, case 3 also contains an arc chute 4 designed to extinguish the electric arc formed between the separable contacts when opening of the latter takes place.

In the embodiment represented in FIGS. 1 and 2, arc chute 4 comprises an arc formation chamber 11 bounded by a first flange 12 and a second flange 13, said flanges being substantially parallel. Flanges 12 and 13 are arranged at equal distance from the longitudinal mid-plane 10 bearing the longitudinal axis A-A'. One of the terminals of the circuit breaker pole-unit is electrically connected to stationary contact 2 and is extended to form an electrode or arcing horn 14 which extends in the upper part of the arc formation chamber. Another terminal of the circuit breaker pole-unit electrically connected to movable contact 1 is connected to another electrode or arcing horn 15 which extends in the bottom part of the arc formation chamber. Electrodes or arcing horns 14 and 15 are arranged in such a way as to pick up an arc drawn between contacts 1 and 2 when separation of the latter takes place. The electric arc formed between the two contacts is thus picked up by the electrodes to be transported and removed to an arc extinguishing chamber 21 of the arc chute.

It should be noted that, in FIG. 2, separable contacts 1 and 2 and electrode 14 have been represented in broken lines as they are hidden in particular by second flange 13. These contacts 1 and 2 are arranged in longitudinal mid-plane 10, at equal distance from the first and second flange. The distance between movable contact 1 and electrode 15 in the bottom part of the arc formation chamber is generally comprised between 4 and 8 millimeters. This distance enables good performances to be obtained for breaking currents of high intensity.

In the embodiment represented, arc extinguishing chamber 21 is formed by a stack of deionizing plates 22 which are generally metal plates. The deionizing plates comprise a leading edge via which the electric arc enters the arc extinguishing chamber. The leading edge of the deionizing plates generally comprises a central recess 23.

In the case of breaking of a high-intensity electric current, the magnetic induction created by flow of the current in electrodes 14 and 15 is generally sufficient to remove the arc to arc extinguishing chamber 21.

In the case of breaking of a low-intensity electric current, the magnetic induction created by flow of the current in electrodes 14 and 15 is no longer sufficient to remove the arc to arc extinguishing chamber 21 and the use of a magnetic field generated by permanent magnets becomes necessary.

According to a first feature of the invention, the arc formation chamber comprises an enhanced induction section 31 in which the arc is propelled to arc extinguishing chamber 21 by the magnetic field generated by a first part of the permanent magnets. The magnetic field, in the longitudinal mid-plane of the arc formation chamber, generated by the first part of the permanent magnets in the enhanced induction section is greater than that generated by the other part of the permanent magnets in the rest of the arc formation chamber. This configuration enables the electric arc to be better propelled and to make the arc leave the separable contacts. Switching of the electric arc root between the movable contact and electrode 15 is therefore mainly achieved by means of the first part of the permanent magnets in the enhanced induction section of the arc formation chamber.

As can be seen in FIG. 2, movement of the electric arc is represented by points at different moments. In the enhanced induction section, the electric arc is represented by points 41 and 42.

In the embodiment represented, the first part of the permanent magnets comprises not only a first magnetized fraction 32, but also a second magnetized fraction 33. The magnetized fractions 32 and 33 are arranged behind each of flanges 12 and 13. What is meant by magnetized fraction of the first part of the permanent magnets is a fraction defined with respect to said first part of the permanent magnets, i.e. with respect to the part of the permanent magnets in the enhanced induction section. The presence of second magnetized fraction 33 of the first part of the permanent magnets generates a magnetic field which is added to that generated by first magnetized fraction 32. This enables the magnetic force induced by the first part of the permanent magnets on the electric arc to be significantly increased. Second magnetized fraction 33 of the first part of the permanent magnets therefore enables the root of the electric arc to be switched between movable contact 1 and electrode 15, and said electric arc to leave and be removed to the arc extinguishing chamber. The effect of the distance D between movable contact 1 and electrode 15 is therefore compensated by the presence of second magnetized fraction 33.

In the embodiment represented in FIGS. 1 and 2, first and second magnetized fraction 32 and 33 of the first part of the permanent magnets generate magnetic fields of substantially equal intensity. The magnetic force to propel the electric arc in the direction of arc extinguishing chamber 21 has thereby been doubled, which enables the electric arc to be propelled more rapidly to the arc extinguishing chamber.

In the embodiment represented in FIGS. 1 and 2, first and second magnetized fraction 32 and 33 of the first part of the permanent magnets are arranged symmetrically with respect to longitudinal mid-plane 10 of the arc formation chamber. This further improves the properties described above, i.e. of propelling the electric arc to the arc extinguishing chamber more efficiently.

According to a second feature of the invention, arc formation chamber 11 comprises a diverting section 51 in which the electric arc is diverted with respect to longitudinal mid-plane 10 of the arc formation chamber to first flange 12 by the magnetic field generated by a second part of the permanent magnets, the magnetic field generated by the second part of the permanent magnets being substantially weaker than that generated by the first part of the permanent magnets. As the magnetic field in longitudinal mid-plane 10 generated by the second part of the permanent magnets is weaker than that of the first part of the permanent magnets and is non-symmetrical with respect to said longitudinal mid-plane, the electric arc is diverted from its trajectory. The diversion component of the electric arc is therefore mainly obtained by means of the second part of the permanent magnets in the diverting section 51.

In the embodiment represented in FIGS. 1 and 2, the whole of second part 52 of the permanent magnets is arranged behind first flange 12. In other embodiments, not represented, only a fraction of the second part of the permanent magnets can be arranged behind the first flange, so that the magnetic field generated by said fraction is greater than that generated by the remaining fraction of the second part of the permanent magnets, the latter being arranged behind second flange 13. What is meant by magnetized fraction of the second part of the permanent magnets is a fraction defined with respect to the part of the permanent magnets in the diverting section.

As can be seen in FIG. 2, in diverting section 51, points 61, 62, 63, 64 and 65 represent the positions of the electric arc in the diverting section at different moments. These points move towards first flange 12 due to the fact that second part 52 of the permanent magnets enables the electric arc to be diverted. In this way, the arc electric moves towards first flange 12 while keeping a sufficient magnetic force along longitudinal axis A-A' so as not to come and stick thereon and end up in contact therewith.

As can be seen in FIG. 2, the leading edge of the deionizing plates is equipped with a central recess 23 and with two lateral parts 71 and 72 directed towards diverting section 51 of the arc formation chamber. In the embodiment represented in FIGS. 1 and 2, the electric arc is directed in the diverting section towards lateral part 71.

In the case of breaking of high-intensity direct currents or alternating currents, it is generally sought to make the arc enter the arc extinguishing chamber via the central recess. This enables the electric arc to be deionized in the middle of the arc extinguishing chamber to dissipate a maximum of energy.

In the case of breaking of a low-intensity current, it is rather sought to make the electric arc enter the arc extinguishing chamber as quickly as possible to prevent it from remaining and dissipating energy within the arc formation chamber, i.e. upstream from the arc extinguishing chamber. In the case of breaking of a low-intensity current, the electric arc can be extinguished on lateral part 71 of the leading edge of arc extinguishing chamber 21 due to the small amount of energy to be dissipated.

Advantageously, the distance between second part 52 of the permanent magnets and lateral part 71 of the deionizing plates is less than 1 millimeter. This distance is sufficiently small to prevent this electric arc from extinguishing in the arc formation chamber.

Flanges 12 and 13 bounding the arc formation chamber are generally formed from an electrically insulating material. To obtain a good electrical endurance with direct currents of low intensity, with relatively long breaking times compared with alternating currents, the flanges can be formed from an electrically insulating material which does not erode easily, such as ceramic, for example steatite. To obtain good breaking with direct or alternating currents of strong intensity, the flanges can be formed from a gas-generating electrically insulating material, for example gas-generating nylon.

Advantageously, first flange 12 is made of ceramic material and second flange 13 is a gas-generating organic material. The gas-generating flange increases the pressure in the contact zone thus fostering departure of the electric arc from the contact zone to the arc extinguishing chamber.

In the embodiment represented in FIGS. 1 and 2, the arc chute comprises a first and second permanent magnet respectively arranged behind each of flanges 12 and 13. The magnet arranged behind first flange 12 extends over the two enhanced induction and diverting sections of the arc formation chamber and the magnet arranged behind second flange 13 extends over the enhanced induction section only. In this case, the first part of the permanent magnets of the enhanced induction section is essentially formed by the first magnet, i.e. magnetized fraction 32, and by the fraction of the second magnet in the enhanced induction section, i.e. magnetized fraction 33. In the same way, the second part of the permanent magnets of the diverting section is essentially formed by the fraction of the second magnet in the diverting section, i.e. magnetized fraction 52.

The invention also extends to an arc chute comprising two permanent magnets arranged behind the first flange respectively in the enhanced induction section and in the diverting section, the magnet in the enhanced induction section generating a magnetic field of substantially stronger intensity than that of the diverting section.

The invention also extends to an arc chute comprising three permanent magnets, a first and second magnet being arranged behind the first flange respectively in the enhanced induction section and in the diverting section, and a third magnet being arranged behind the second flange in the enhanced induction section.

The invention claimed is:

1. An arc chute for a circuit breaker comprising an arc extinguishing chamber formed by a stack of deionizing plates and an arc formation chamber bounded by a first and second flange situated on each side of a longitudinal mid-plane of said chamber, said arc chute being equipped with permanent magnets at least partially arranged behind the first flange, wherein the arc formation chamber comprises a first enhanced induction section and a diverting section between said enhanced induction section and the arc extinguishing chamber:

the enhanced induction section comprising a first part of the permanent magnets generating a magnetic field in the longitudinal mid-plane of said section enabling the electric arc to be propelled, said first part of the permanent magnets comprising two magnetized fractions arranged behind each of the flanges, the diverting section comprising a second part of the permanent magnets generating a substantially weaker magnetic field in the longitudinal mid-plane of said section than that generated by the first part of the permanent magnets and enabling the electric arc to be diverted with respect to the longitudinal mid-plane.

2. The arc chute according to claim 1, wherein the first and second flange are situated substantially at equal distance from the longitudinal mid-plane.

3. The arc chute according to claim 2, wherein the two magnetized fractions of the first part of the permanent magnets generate magnetic fields having substantially equal intensities.

4. The arc chute according to claim 2, wherein the two magnetized fractions of the first part of the permanent magnets are arranged symmetrically with respect to the longitudinal mid-plane of the arc formation chamber.

5. The arc chute according to claim 1, wherein at least a fraction of the second part of the permanent magnets is arranged behind the first flange so that the magnetic field generated by said fraction is greater than that generated by the remaining fraction of the second part of the permanent magnets.

6. The arc chute according to claim 5, wherein the whole of the second part of the permanent magnets is arranged behind the first flange.

7. The arc chute according to claim 1, wherein the deionizing plates comprise a leading edge equipped with a central recess and with at least one lateral part directed towards the diverting section, the electric arc being directed in the diverting section towards said lateral part.

8. The arc chute according to claim 7, wherein the distance between the second part of the permanent magnets and the lateral part of the leading edge of the deionizing plates is less than 1 millimeter.

9. The arc chute according to claim 1, wherein the first flange is made of ceramic material.

10. The arc chute according to claim 9, wherein the second flange is a gas-generating organic material.

11. A circuit breaker comprising separable contacts and an arc chute to extinguish an electric arc formed when opening of said contacts takes place, wherein the arc chute is according to claim 1.

* * * * *